United States Patent [19]

Petersen

[11] 4,375,018

[45] Feb. 22, 1983

[54] MEMBRANE SWITCH HAVING ADHESIVE LABEL AS EDGE SEAL

[75] Inventor: Stephen K. Petersen, Rosemount, Minn.

[73] Assignee: Sheldahl, Inc., Northfield, Minn.

[21] Appl. No.: 159,954

[22] Filed: Jun. 16, 1980

[51] Int. Cl.[3] ..... H01H 13/70

[52] U.S. Cl. ..... 200/5 A

[58] Field of Search ..... 200/5 A, 5 R, 159 B, 200/307, 308, 317, 1 R

[56] References Cited

U.S. PATENT DOCUMENTS

| | | | |
|---|---|---|---|
| 3,627,927 | 12/1971 | Schmitz et al. | 200/5 A X |
| 3,699,294 | 10/1972 | Sudduth | 200/5 A X |
| 3,862,381 | 1/1975 | Glaister et al. | 200/159 B X |
| 3,886,335 | 5/1978 | Hendricks | 200/1 R |
| 3,917,917 | 11/1975 | Murata | 200/302 X |
| 3,959,610 | 5/1976 | Finnegan et al. | 200/5 A |
| 3,978,297 | 8/1976 | Lynn et al. | 200/302 X |
| 4,046,975 | 9/1977 | Seeger, Jr. | 200/159 B X |
| 4,066,851 | 1/1978 | White et al. | 200/159 B X |
| 4,085,302 | 4/1978 | Zenk et al. | 200/5 A |
| 4,090,045 | 5/1978 | Marsh | 200/308 X |
| 4,096,577 | 6/1978 | Ferber et al. | 200/5 A X |
| 4,158,115 | 6/1979 | Parkinson et al. | 200/5 A |
| 4,217,473 | 8/1980 | Parkinson | 200/159 B |

OTHER PUBLICATIONS

IBM Technical Disclosure Bulletin; G. G. Promis et al.; "Control Panel"; vol. 19; No. 2; Jul. 1976; pp. 405, 406.

IBM Technical Disclosure Bulletin; J. R. Lester et al.; "Switch"; vol. 11; No. 11; Apr. 1969; p. 1569.

IBM Technical Disclosure Bulletin; D. O. Johnson, Jr.; "Keyboard and Wiping Contact Assembly"; vol. 13; No. 7; Dec. 1970; pp. 1962, 1963.

*Primary Examiner*—J. R. Scott

*Attorney, Agent, or Firm*—Orrin M. Haugen; Thomas J. Nikolai

[57] ABSTRACT

A membrane switch comprised of first and second flexible layers having corresponding patterns of metallization thereon, these layers being separated by an apertured spacer. The first layer is of a larger size than the spacer and the second layer is of a smaller size than the spacer so that when the three are superposed, a border on the first layer and spacer are exposed to meet the second layer. Completing the assembly is a label layer which is of a flexible, non-conductive material having a desired pattern of graphics printed on it and an adhesive coated undersurface. When the label layer is pressed against the exposed surface of the second substrate, it bonds all three of the lower layers together and creates a seal around the perimeter of the switch assembly. With the label layer being of a greater size than the other three layers, it may also be used to affix the composite switch to the appliance on which it would be used.

4 Claims, 3 Drawing Figures

MEMBRANE SWITCH HAVING ADHESIVE LABEL AS EDGE SEAL

BACKGROUND OF THE INVENTION

I. Field of the Invention

This invention relates generally to membrane or diaphragm switches, and more specifically to an improved construction of such switches whereby the reliability of the resulting product is increased and the manufacturing cost is reduced.

II. Discussion of the Prior Art

Diaphragm or membrane switches are now widely used in conjunction with a variety of electrical and electronic appliances. Typically, these switches comprise a base layer having a pattern of conductive switch contacts disposed thereon and overlaying this base layer is a spacer layer which has plurality of apertures which are aligned with the conductive elements on the base layer when the spacer layer is superimposed on the base layer. Atop the spacer layer is a further flexible plastic layer having a pattern of conductive switch contacts on the underside thereof, this conductive pattern also being aligned with the apertures in the spacer layer. This upper layer commonly has graphics on its exposed outer surface to identify particular switch positions. The application of finger force to a marked area on the graphics layer results in the upper flexible layer being deformed through the aperture in the spacer layer so a circuit path is completed between the two switch contacts. The memory properties of the plastic from which the upper flexible layer is fabricated allow the switch contacts to separate once the finger force is removed.

It has been the existing practice in the fabrication of membrane switches to adhesively bond the spacer layer to the lower substrate and then to likewise bond the upper metallized layer to the other major surface of the spacer member. Then, the graphics may be imprinted on the exposed surface of the upper flexible layer or, alternatively, a separate label layer may be adhesively bonded to the upper flexible layer.

The various steps of bonding one layer to the other increases the overall manufacturing cost of the membrane switch. I have conceived of a way of manufacturing a membrane switch whereby the overall manufacturing cost is reduced without an attendant reduction in the reliability or useful life of the resulting switch array.

SUMMARY OF THE INVENTION

In accordance with my invention, there is provided a lower flexible substrate having a pattern of metallization thereon with conductive elements being disposed at predetermined coordinate locations. The substrate may be rectangular, circular, oval or any other shape. Next, a spacer layer is provided, the spacer layer having a pattern of apertures which correspond to the same coordinate locations as the metallization on the lower flexible substrate. The spacer layer has the same geometric shape as the lower substrate, but is of a smaller size in all dimensions so that when it is positioned atop the lower substrate layer with the apertures aligned with the pattern of metallization, a border or perimeter zone of the lower substrate will extend beyond the edges of the spacer layer. Next, a further substrate, i.e., the upper substrate, is provided and it has a pattern of metallization on the undersurface thereof with the pattern corresponding to the same coordinates as the pattern on the lower substrate. Thus, when the upper substrate is stacked on top of the spacer layer, the conductive elements will be aligned vertically with the pattern on the lower substrate, but will be spaced apart from them by the thickness dimension of the spacer layer. Again, the upper substrate has the same geometric shape as the lower substrate and the spacer layer, but is of a smaller dimension so that when positioned atop the spacer layer the edges of the spacer layer will extend beyond those of the upper substrate around the perimeter of the assembly.

The upper and lower substrate segments may comprise the same sheet of flexible plastic material with their respective patterns of metallization symmetrically disposed on the same surface on opposite sides of a fold-line such that when folded with the spacer layer sandwiched therebetween, their conductive segments will be aligned with the spacer apertures.

Once the various members are superimposed one above the other with the proper registration maintained, a label layer which is also formed from a flexible material and which has a pressure sensitive adhesive coated on the undersurface thereof is pressed onto the exposed upper surface of the upper substrate. The dimensions of the label layer are at least as large as those of the lower substrate and, hence, the borders of the lower substrate, the spacer layer and the upper substrate are all individually adhesively bonded to the label layer. Because of the staggered relationship of the various parts, no noticeable irregularity or ripple appears on the exposed surface of the label layer.

By using the technique of the present invention, it is unnecessary to use pressure sensitive adhesive to bond the spacer to the lower substrate and the upper substrate to the spacer. This appreciably reduces the manufacturing cost of the switch array. Further, because the upper label layer is adhesively bonded to the edges of all of the other layers within the diaphragm switch, a perimeter seal is established precluding moisture or dust particles from entering into the switch array and possibly compromising the integrity of the switch contacts.

OBJECTS

It is accordingly the principal object of the present invention to provide a new and improved diaphragm-type electrical switch array.

Another object of the invention is to provide an improved diaphragm-type switch array which can be produced at a lower relative cost than known prior art arrangements.

A still further object of the invention is to provide a diaphragm switch array in which the individual parts are held together by an adhesive coating applied to only one layer in the assembly.

A still further object is to provide a diaphragm-type switch array in which the spacer layer and the upper substrate are of the same shape but of a lesser area than the layers immediately below whereby when an upper label layer of the same or greater area than the lower substrate is adhesively bonded to the assembly, the several parts are each bonded to the label layer about their respective perimeters.

These and other objects and advantages of the invention will become apparent to those skilled in the art from the following detailed description of a preferred embodiment, when considered in conjunction with the accompanying drawings.

DESCRIPTION OF THE PREFERRED EMBODIMENT

Figure 1:
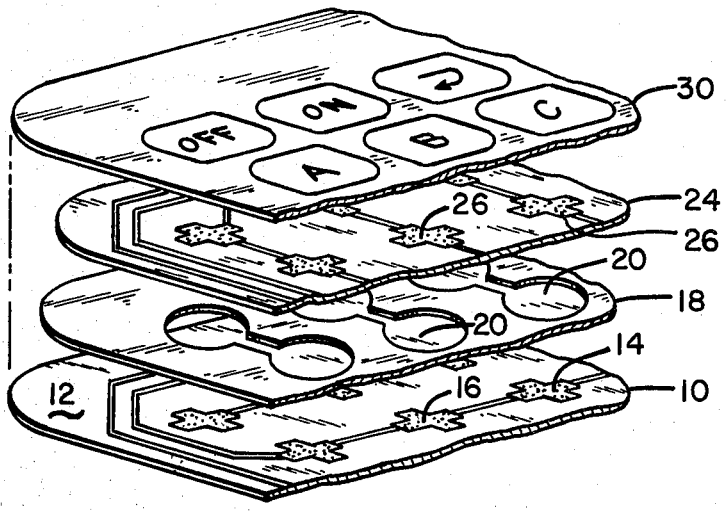
FIG. 1 is an exploded partial view of the preferred embodiment.
Figure 2:
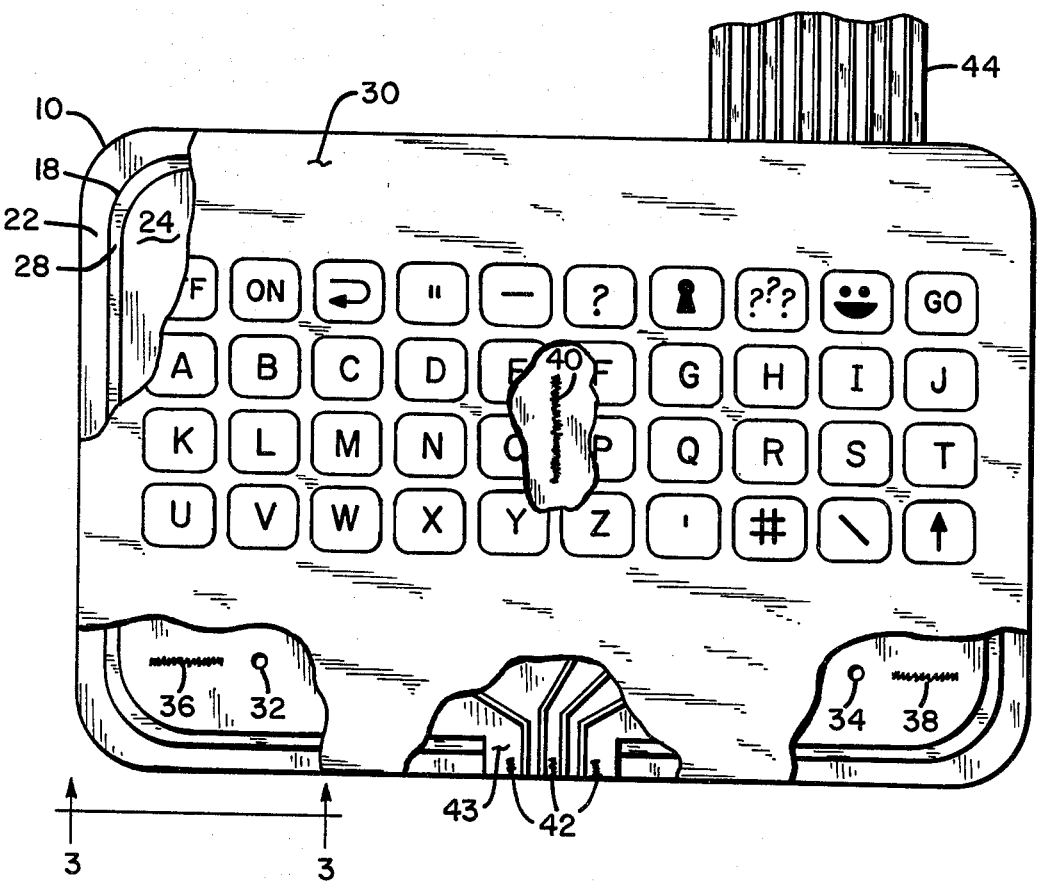
FIG. 2 is a plan view of the switch array with various layers broken away to show underlying features used in the construction.
Figure 3:
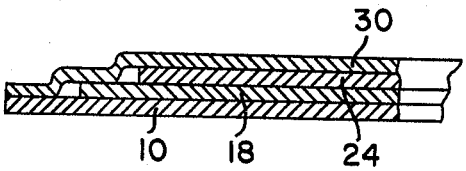
FIG. 3 is a fragmentary end view as seen along the line 3—3 in FIG. 2.

Referring to FIG. 1, the internal construction of the diaphragm switch of the present invention is illustrated. Numeral 10 refers to the lower or base substrate and this may comprise a thin sheet of a flexible plastic material. Sheet materials of plastics sold under the trademarks Mylar, Kapton or Tradlon have been found to be entirely suitable. Formed on the upper surface 12 of the substrate 10 is a pattern of conductive elements as at 14, 16, these elements being disposed at predetermined spaced apart locations, preferably in the form of a rectangular grid. The conductive elements may be formed from a silver/graphite paste when a silk-screening process is the method employed for applying the conductive elements 14 and 16 to the substrate 10. Alternatively, the conductive pattern may be formed from copper or other conductive materials using any of the various well-known printed circuit techniques. With reference to FIG. 2, it can be seen that the lower substrate 10 may be generally rectangular in shape, but limitation to this shape is not essential as will become apparent as the description of the preferred embodiment progresses.

Disposed immediately above the lower substrate layer 10 is a spacer member 18 having a pattern of apertures, as at 20, formed through the thickness dimension thereof, the center-to-center spacing of the apertures being consistent with the center-to-center spacing of the conductive elements 14, 16, etc. on the upper surface 12 of the lower substrate 10. The spacer member has the same general shape in its plan view as the lower substrate 10, but is of a smaller area such that a peripheral portion or border zone 22 on the lower substrate extends outwardly from the side edges of the spacer member 18 when that member is positioned on the lower substrate with the apertures 20 aligned with the metallization elements 14 and 16. The spacer layer 18 may also be fabricated from a sheet of suitable plastic material such as those trademarked Mylar, Kapton or Tradlon.

Disposed immediately above the spacer layer 18 is a further (upper) substrate layer 24. The upper substrate has a pattern of metallization on its undersurface which, too, may be formed using silk-screening, copper etching or any other suitable and well-known printed circuit process. The center-to-center spacing of the conductive elements 26 corresponds to the spacing between elements on the lower substrate 10 so that when the upper substrate layer 24 is superimposed over the spacer layer and properly registered, the conductive elements 26 will be generally aligned with the conductive elements 14 and 16, but will be maintained out of contact with one another by the thickness dimension of the spacer member 18.

The upper substrate member 24 has the same general shape in its plan view as the lower substrate and the spacer member. However, the area of the upper substrate 24 is less than that of the spacer member such that when properly registered, a border zone 28 of substrate 18 extends beyond the edges of the upper substrate 24.

Completing the assembly is an upper cover or label layer 30 which may typically have alphanumerics or other graphics printed thereon at spaced apart locations corresponding to the locations of the metallization elements 26, the apertures 20 and the elements 14, 16 on the several layers. The label layer 30 is also preferably formed from a suitable flexible plastic material having a memory property and on the undersurface thereof is a coating 31 of a suitable pressure-sensitive adhesive. The layer 30 is generally of the same size as the lower substrate 10 such that when it is pressed firmly into contact with the members 24, 18 and 10, the exposed borders 22, 28 and the surface 24 will all adhere to the label layer 30, thereby holding all of the parts together and forming a seal about the entire perimeter.

With reference to FIG. 2, during manufacture, it has been found convenient to form registration holes 32 and 34 through the layers 10, 18 and 24. Then, by stacking these parts onto a manufacturing jig having spaced-apart pins extending upward from it, the parts are held in proper registration. Once so registered, it has also been found helpful to ultrasonically bond or otherwise tack or join the layers 24, 18 and 10, one to the other, as at 36, 38, 40 and 42 to hold the various parts in their proper registration during handling prior to the application of the adhesively coated label layer 30 as the final step in the manufacturing process.

Furthermore, it has been found expedient from a cost standpoint to use a common sheet of flexible plastic material for both the lower substrate 10 and the upper substrate 24. To do so, the pattern of metallization is formed symmetrically on opposite sides of a fold-line such that when the common substrate is folded along that line with the spacer layer 18 inserted between the folded "halves" the metallized elements on the lower half will be vertically aligned with those on the upper half. The common sheet is also cut so that the portion which will become the upper substrate section will be of lesser size than either the lower portion or the spacer to be used, the two segments being joined only by a narrow strip 43 which permits conductors to extend between the two "halves". To ensure that the fold zone does not spread apart and overcome the adhesive force of the label layer to thereby destroy the seal, it has been found helpful to also ultrasonically bond the substrates 10 and 24 together in the zone of the strips 43 proximate their point of folding as at 42. Numeral 44 refers to the portion of the substrate 10 having conductors thereon which is brought out to be connected to the external circuitry with which the switch array is to be used.

Because the members 18 and 24 are gradually successively stepped inwardly from the outermost edge perimeter of the assembly, no noticeable or unsightly step is observable on the exposed outer surface of the label layer 30.

Where the diaphragm switch array of the present invention is to be used on an appliance having a generally flat surface, it has been found expedient to extend the borders of the label layers outward beyond the edges of the lower substrate 10 and, in this fashion, the switch assembly may be adhesively bonded to the flat surface of the appliance.

There has been shown and described a preferred embodiment of the invention and the best mode contemplated by me for carrying out the invention. Those skilled in the art, upon reading the present specification may conceive of variations which do not depart in spirit from the true scope of the invention. Accordingly, it is intended that the scope of the invention be determined from the accompanying claims.

What is claimed is:

1. A membrane switch comprising:

(a) a first substrate member formed from a flexible insulative material having a first pattern of conductive elements at predetermined coordinate locations thereon;

(b) an insulative spacer member superimposed on said first substrate member and having a pattern of apertures therethrough at said predetermined coordinate locations, said spacer member being of a smaller size such that when superimposed on said first substrate member with said pattern of apertures aligned with said first pattern of conductive elements, a predetermined area of said first substrate member proximate the periphery thereof extends outwardly beyond the edges of said spacer member;

(c) a second substrate member formed from a flexible insulative material superimposed on said spacer member having a second pattern of conductive elements at predetermined coordinate locations corresponding to said predetermined coordinate locations of said apertures on said spacer member, said second substrate being of a smaller size than said spacer member such that when superimposed on said spacer member with said second pattern of conductive elements aligned with said apertures, a predetermined area of said spacer member proximate the perimeter thereof extends outwardly beyond the edges of said second substrate member; and (d) a flexible insulative cover layer overlying said superimposed members in superficial engagement with at least peripheral portions thereof, and having an adhesive coating on one major surface thereof for individually bonding and sealing at least perimeter portions of said second substrate, said spacer member and said first substrate member to said cover layer.

2. A membrane switch as in claim 1 wherein said first and second substrate members are joined by an integrally formed strip, said strip being folded so that said patterns of conductive elements on said first and second substrate members are aligned with said apertures in said spacer member, the width of said integrally formed strip being substantially less than the widths of said substrate members joined thereby.

3. A membrane switch comprising at least a pair of superimposed thin flexible members, the lower member being of greater area than the upper member to extend therebeyond peripherally;

(a) and a thin flexible cover layer overlying said members and adhesively secured to at least a peripheral portion of each said member to individually bond said members to said cover layer.

4. A membrane switch comprising a plurality of superimposed thin flexible members, each lower member being of greater area than any upper member above it to extend therebeyond peripherally, (a) and a thin flexible cover layer overlying said plurality of members and adhesively secured to at least a peripheral portion of each said member to individually bond said members to said cover layer.

* * * * *